US006862856B2

(12) United States Patent
Turgeon-Schramm et al.

(10) Patent No.: US 6,862,856 B2
(45) Date of Patent: Mar. 8, 2005

(54) CORNER BLOCK FOR USE IN FORMING A CORNER OF A SEGMENTAL RETAINING WALL

(75) Inventors: John Walter Turgeon-Schramm, Brooklyn Park, MN (US); Donal Jay Armstrong, St. Louis Park, MN (US)

(73) Assignee: Anchor Wall Systems, Inc., Minnetonka, MN (US)

( * ) Notice: Subject to any disclaimer, the term of this patent is extended or adjusted under 35 U.S.C. 154(b) by 0 days.

(21) Appl. No.: 10/072,106

(22) Filed: Feb. 8, 2002

(65) Prior Publication Data

US 2003/0150184 A1 Aug. 14, 2003

(51) Int. Cl.[7] ..... E04C 3/30

(52) U.S. Cl. ..... 52/561; 52/603; 52/605; 52/607; 405/262; 405/286

(58) Field of Search ..... 52/561, 603, 604, 52/605, 607, 283, 284, 286; 405/286, 284, 262; D25/58, 102, 113–115, 118

(56) References Cited

U.S. PATENT DOCUMENTS

| | | | | | |
|---|---|---|---|---|---|
| 738,643 | A | * | 9/1903 | Van Camp | 52/284 |
| 1,391,318 | A | * | 9/1921 | Heath | 52/284 |
| 1,418,464 | A | * | 6/1922 | Praetorius | 52/604 |
| 1,424,172 | A | * | 8/1922 | Levy | 52/437 |
| 1,500,493 | A | * | 7/1924 | Huffman | 52/510 |
| 1,841,233 | A | * | 1/1932 | Whiting | 52/592.5 |
| 1,853,231 | A | * | 4/1932 | Schonert | 52/59 |
| 2,151,468 | A | * | 3/1939 | Henderson | 52/204.1 |
| 2,226,369 | A | * | 12/1940 | Campfield | 52/59 |
| 2,994,162 | A | * | 8/1961 | Frantz | 52/592.5 |
| 4,193,241 | A | * | 3/1980 | Jensen et al. | 52/405.4 |
| 4,340,360 | A | * | 7/1982 | Hoedl et al. | 432/119 |
| 4,565,043 | A | * | 1/1986 | Mazzarese | 52/592.6 |
| 4,914,876 | A | | 4/1990 | Forsberg | |
| 5,064,313 | A | | 11/1991 | Risi et al. | |
| 5,066,169 | A | | 11/1991 | Gavin et al. | |
| 5,123,221 | A | * | 6/1992 | Legault | 52/293.2 |
| 5,248,226 | A | * | 9/1993 | Risi et al. | 405/284 |
| 5,282,700 | A | * | 2/1994 | Rodrique | 405/284 |
| 5,351,457 | A | * | 10/1994 | Colen | 52/438 |
| 5,417,523 | A | * | 5/1995 | Scales | 405/284 |
| 5,540,525 | A | | 7/1996 | Miller et al. | |
| 5,595,460 | A | * | 1/1997 | Miller et al. | 405/284 |
| 5,607,262 | A | | 3/1997 | Martin | |
| 5,673,530 | A | | 10/1997 | Bailey, II | |
| 5,688,079 | A | | 11/1997 | Bolduc et al. | |
| 5,709,062 | A | | 1/1998 | Woolford | |
| 5,735,643 | A | | 4/1998 | Castonguay et al. | |
| 5,800,097 | A | | 9/1998 | Martin | |
| 5,820,304 | A | * | 10/1998 | Sorheim et al. | 405/286 |
| 5,826,395 | A | * | 10/1998 | Weaver | 52/606 |
| 5,827,015 | A | | 10/1998 | Woolford et al. | |
| 5,921,715 | A | | 7/1999 | Rainey | |
| 5,984,589 | A | | 11/1999 | Ciccarello | |
| 6,065,265 | A | * | 5/2000 | Stenekes | 52/607 |
| 6,079,908 | A | * | 6/2000 | Anderson | 405/262 |
| 6,168,351 | B1 | | 1/2001 | Rainey | |
| 6,318,934 | B1 | | 11/2001 | Borgersen et al. | |
| 6,322,291 | B1 | | 11/2001 | Rainey | |
| 6,338,597 | B1 | | 1/2002 | Rainey | |
| 6,416,257 | B1 | | 7/2002 | Rainey | |

OTHER PUBLICATIONS

US 6,089,793, 7/2000, Rainey (withdrawn)

* cited by examiner

*Primary Examiner*—Korie Chan
(74) *Attorney, Agent, or Firm*—Merchant & Gould P.C.

(57) ABSTRACT

A corner block is provided for use in constructing an exterior corner of a retaining wall. The corner block is designed to receive a portion of a retaining member that is used to secure a reinforcement member to blocks that are adjacent to the corner block. The corner block permits construction of a retaining wall having an exterior corner, where the right and left sides of the exterior corner can be reinforced.

12 Claims, 9 Drawing Sheets

FIG. 1A
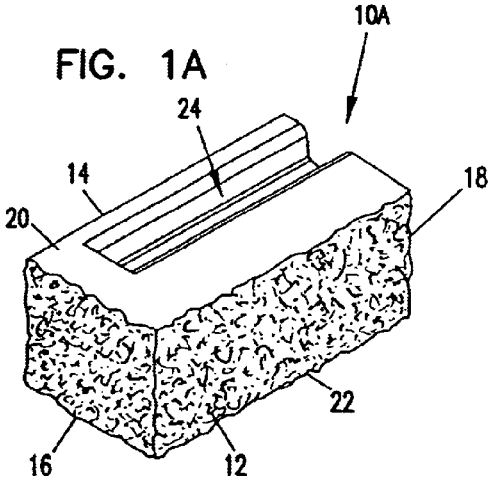
FIG. 1B
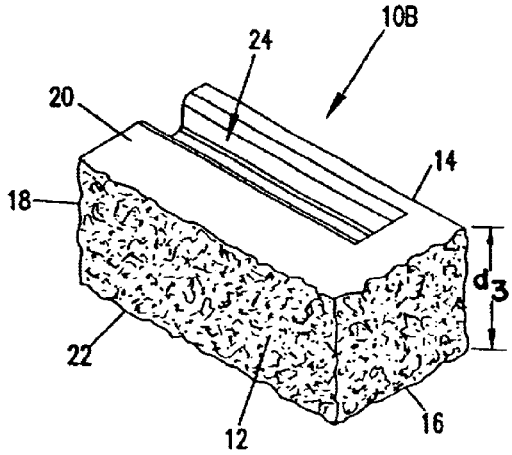
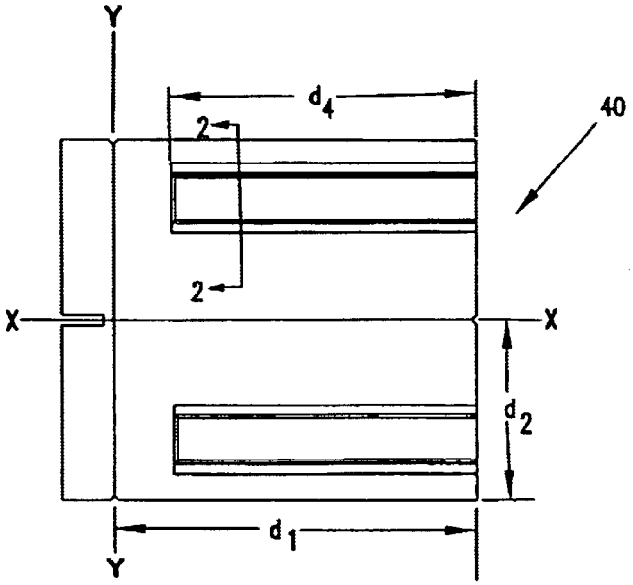
FIG. 3

CORNER BLOCK FOR USE IN FORMING A CORNER OF A SEGMENTAL RETAINING WALL

FIELD OF THE INVENTION

The invention relates generally to earth retaining walls and masonry blocks that may be used in construction of such retaining walls. More specifically, the invention relates to a corner masonry block for use in forming a corner of a segmental retaining wall system, as well as to a segmental retaining wall utilizing such corner masonry blocks.

BACKGROUND OF THE INVENTION

Segmental retaining walls commonly comprise courses of modular units (blocks). The blocks are typically made of concrete. The blocks are typically dry-stacked (no mortar or grout is used), and often include one or more features adapted to properly locate adjacent blocks and/or courses with respect to one another, and to provide resistance to shear forces from course to course. The weight of the blocks is typically in the range of ten to one hundred fifty pounds per unit.

Segmental retaining walls commonly are used for architectural and site development applications. Such walls are subjected to high loads exerted by the soil behind the walls. These loads are affected by, among other things, the character of the soil, the presence of water, surcharge, and seismic loads. To handle the loads, segmental retaining wall systems often comprise one or more layers of soil reinforcement material extending from between the courses of blocks back into the soil behind the blocks. The reinforcement material is typically in the form of geosynthetic reinforcement material such as geogrid or geotextile fabric. Geogrids often are configured in a lattice arrangement and are constructed of polymer fibers or processed plastic sheet material (punched and stretched, such as described, for example, in U.S. Pat. No. 4,374,798), while geotextile fabrics are constructed of woven or knitted polymer fibers. These reinforcement members typically extend rearwardly from the wall and into the soil to stabilize the soil against movement and thereby create a more stable soil mass, which results in a more structurally secure retaining wall. In other instances, the reinforcement members comprise tie-back rods that are secured to the wall and which extend back into the soil or into rock.

Although several different forms of reinforcement members have been developed, opportunities for improvement remain with respect to attachment of the reinforcement members to the facing blocks in the retaining wall systems. As a general proposition, the more efficient the block/reinforcement connection, the fewer the layers of reinforcement material that should be required in the wall system. The cost of reinforcing material can be a significant portion of the cost of the wall system, so highly efficient block/reinforcement material connections are desirable.

Many segmental retaining wall system rely primarily upon frictional forces to hold the reinforcement material between adjacent courses of block. The systems may also include locating pins or integral locator/shear resistance features that enhance the block/reinforcement material connection to varying degrees. Examples of such systems include those described in U.S. Pat. Nos. 4,914,876, 5,709,062, and 5,827,015. These systems cannot take advantage of the full tensile strength of the common reinforcement materials, however, because the block/reinforcement material holding forces that can be generated in these systems is typically less than the tensile forces that the reinforcing materials themselves can withstand.

One of the many advantages of segmental retaining wall systems over other types of retaining walls is their flexibility. They do not generally require elaborate foundations, and they can perform well in situations where there is differential settling of the earth, or where frost heaving, for example, occurs. Even so, these types of conditions might result in differentials in the block/reinforcement material connections across the wall in systems that rely primarily on frictional connection of blocks to the reinforcement material.

In an effort to improve the block/reinforcement material connection efficiency, several current retaining wall systems have been developed that mechanically connect the reinforcement members to the blocks. In several such systems, rake shaped connector bars are positioned transversely in the center of the contact area between adjacent stacked blocks with the prongs of the connector bars extending through elongated apertures provided in the reinforcement member to retain it in place. Examples of this type of system are shown in U.S. Pat. Nos. 5,607,262 (FIGS. 1–7), 5,417,523, and 5,540,525.

These systems are only effective if the reinforcement member used is of a construction such that the cross-members that engage the prongs of the connector will resist the tensile forces exerted on the reinforcement member by the soil. There are only a few such reinforcement members currently available and, thus, the wall builder or contractor has to select reinforcement members from a limited number of manufacturers when such an attachment system is used. These systems also rely upon the prongs of the rake connectors being in register with the apertures in the reinforcement member and in contact with cross members of the reinforcement member. If the connector prongs do not line up with the apertures, installation becomes a problem. Variability in the manufacturing process of reinforcement members means that the apertures in this type of reinforcement member frequently are not perfectly regular. A solution to this problem has been to use short connector rakes that only engage several apertures, rather than long connectors that engage all of the apertures in a row across the reinforcement member. This solution eases problems, but would appear to make the connection mechanism less efficient. These devices are subject to the same criticisms as the pure friction connectors.

A third type of connector system uses a channel that, in cross-section, has a relatively large inner portion and a very narrow opening out of that portion. The reinforcement member is provided with a bead or equivalent along its leading edge. The reinforcement member is then threaded into the channel from the side, so that the reinforcement member extends out through the narrow channel opening, but the bead is captured in the larger inner portion. An example of this type of connection is shown in FIGS. 9 and 10 of U.S. Pat. No. 5,607,262. While this system overcomes differential settling concerns, it is very difficult to use in the field, and relies upon special reinforcement member configurations.

A modification of the third type of connector system described above is one in which the channel into which the bead fits is formed by a combination of the lower and adjacent upper block, so that the enlarged/beaded end of the reinforcement member can simply be laid in the partial channel of the lower blocks, and will be captured when the upper blocks are laid. This system simplifies installation, but does not resolve the aforementioned performance concerns. In a variation of this system, the end of a panel of reinforcement material is wrapped around a bar, which is then placed in a hollowed-out portion of the facing unit which is provided with an integral stop to resist pullout of the bar. Rather than being held in place by the next above facing unit, the wrapped bar is then weighted down with earth or gravel fill dumped on top of it in the hollowed out portion of the facing unit. This system is shown in U.S. Pat. No. 5,066,169. Not only is the facing unit of this system extremely complex and difficult to make, but the installation process is difficult and requires the use of very narrow panels of reinforcement material.

A solution to the problems discussed above is disclosed in patent application Ser. Nos. 09/049,627 (filed on May 27, 1998) and 09/487,820 (filed on Jan. 18, 2000), each of which is assigned to Anchor Wall Systems, Inc. The applications disclose retaining wall blocks provided with lock channels and lock flanges that provide a locking mechanism for resisting leaning or toppling of the blocks. A retaining mechanism in the form of a retaining bar interacts with a lock channel formed in the block to retain a geosynthetic reinforcement material within the channel.

A retaining wall constructed with an exterior corner presents unique challenges with respect to the use of geosynthetic reinforcement material. In a generally linear modular retaining wall structure, the forces acting on the wall tend to act in a single direction, i.e. in a direction tending to topple the wall forward. Therefore, geosynthetic reinforcement material connected to the blocks forming the linear wall and extending rearwardly from the wall and into the soil provides acceptable stability. However, with an exterior corner, the pressures resulting from the soil, surcharge, and seismic loads, are exerted on both walls of an exterior corner. Therefore, to achieve the maximum benefits from the geosynthetic reinforcement material and provide adequate stability adjacent an exterior corner, the geosynthetic reinforcement material should be connected to the blocks that form the right and left sides of an exterior corner.

An additional factor to be considered when constructing a segmental retaining wall structure is the need to offset the vertical joints in each course from the vertical joints in the courses located above and below each course. Alignment of the vertical joints in a wall is generally thought to detract from the appearance of the resulting wall structure, and it is typically common in the art to avoid vertical joint alignment.

The need to avoid vertical joint alignment in the courses of the wall structure presents difficulties at an exterior corner. First, uniform-sized corner blocks often cannot be used, due to setback of the blocks in the remaining wall structure. In addition, the blocks that form the exterior corner must also be constructed and positioned to prevent vertical joint alignment.

It can therefore be appreciated that there exists a need for a corner block, for use in a retaining wall having an exterior corner, that is constructed to permit interaction with geosynthetic reinforcement material so as to stabilize both the right and left sides of the corner, and which does not have vertical alignment of joints.

SUMMARY OF THE INVENTION

A corner block is provided for use in constructing an exterior corner of a retaining wall. The corner block is useable with geosynthetic reinforcement whereby an exterior corner of a retaining wall that includes the corner blocks described herein can be reinforced. By constructing a retaining wall with an exterior corner using the corner blocks of the invention, geosynthetic reinforcement can be used to reinforce the right side of the corner, and geosynthetic reinforcement can be used to reinforce the left side of the corner. Therefore, the right and left sides of the exterior corner can be stabilized against the forces acting on the exterior corner.

In one aspect of the invention, a corner block is provided that comprises a block body having opposed side surfaces, opposed end surfaces, a top surface and a bottom surface. At least two of the side and end surfaces that are adjacent are textured. The block also includes a channel formed in the top surface, with the channel having a longitudinal axis extending parallel to the side surfaces. The channel further includes an open end that extends through one of the end surfaces, such as the end surface that is not textured, and a closed end that terminates short of the opposite end surface. The channel is defined by at least a front wall, a rear wall opposite the front wall, and a bottom wall, and the channel is sized to receive therein a portion of an elongated retaining member such that the retaining member extends parallel to the longitudinal axis of the channel.

In another aspect of the invention, a retaining wall having an exterior corner is provided. The wall includes a plurality of courses, with each course having a first plurality of blocks forming an exterior corner, a second plurality of blocks forming a right wall portion adjacent the exterior corner, and a third plurality of blocks forming a left wall portion adjacent the exterior corner. A first reinforcement member is retained between the second plurality of blocks of mating courses and extends into soil retained by the wall. In addition, a first retainer secures the first reinforcement member to the second plurality of blocks of one of the mating courses. Moreover, a second reinforcement member is retained between the third plurality of blocks of mating courses and extends into the soil retained by the wall, and a second retainer secures the second reinforcement member to the third plurality of blocks of the mating courses.

In yet another aspect of the invention, a retaining wall includes a plurality of blocks arranged into courses and defining an exterior corner. At least one course at the exterior corner is formed from a plurality of subcourses of blocks.

The features and advantages of the invention will become apparent upon reading the following specification, when taken in conjunction with the accompanying drawings.

BRIEF DESCRIPTION OF THE DRAWINGS

FIGS. 1A and 1B are perspective views of right and left corner blocks, respectively, of the present invention.

FIG. 3 illustrates a workpiece that is used to produce the right and left corner blocks.

DETAILED DESCRIPTION OF THE PREFERRED EMBODIMENTS

Figure 2:
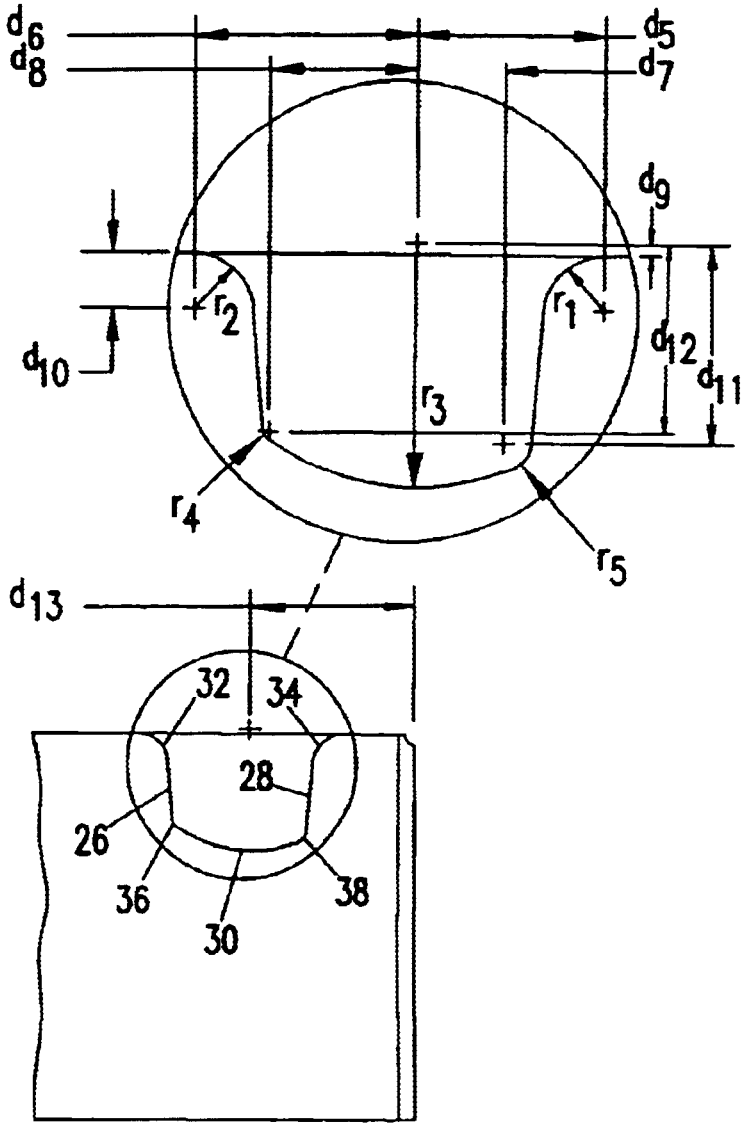
FIG. 2 is a partial cross-sectional view of a portion of the right corner block taken along line 2—2 of FIG. 3, with the channel provided in a top surface of the corner block shown in detail.

Referring now in more detail to the drawings, in which like numerals indicate like parts throughout the several views, FIGS. 1A and 1B illustrate right and left corner blocks 10A, 10B, respectively, constructed in accordance with the invention. The corner blocks 10A, 10B of the invention function together with the blocks described in commonly assigned U.S. patent application Ser. No. 09/487,820 in order to form an exterior corner of a retaining wall that is reinforced by geosynthetic reinforcing material. U.S. patent application Ser. No. 09/487,820 is incorporated herein by reference in its entirety. The term "geosynthetic reinforcing material" used herein is meant to include both geogrids and geotextile fabrics.

Each block 10A, 10B comprises first and second opposed side surfaces 12, 14, first and second opposed end surfaces 16, 18, a top surface 20 and a bottom surface 22. The surfaces 12, 16 of each block 10A, 10B form exterior surfaces of the blocks that typically are visible when laid up in a wall. Accordingly, the exterior surfaces 12, 16 are typically provided with an ornamental facing to create what is generally considered to be a visually pleasing facade. The surfaces 12, 16 can be textured as a result of a splitting process used to form the blocks. Other processes that result in ornamental facings on the surfaces 12, 16 could also be used. The surface 14 of each block 10A, 10B forms an interior surface that, in use, faces to the interior of the wall.

In addition, the top and bottom surfaces 20, 22 of each block are preferably, but not necessarily, parallel to each other so that, when stacked on top of one another, an upright wall can be formed. Further, the opposed surfaces 12, 14 and 16, 18 are preferably, but not necessarily, generally parallel to each other.

Each block 10A, 10B further includes a channel 24 formed in the top surface 20. The longitudinal axis of the channel 24 extends generally parallel to the side surfaces 12, 14, with one end of the channel 24 extending through the end surface 18 and the opposite end of the channel terminating short of the end surface 16. The channel 24 is offset on the top surface 20 of the respective block, such that the channel is positioned closer to the side surface 14 than it is to the side surface 12. Alternatively, the channel 24 could be positioned such that it is positioned closer to the side surface 12 than it is to the side surface 14.

The channel 24, in use, is designed to receive an end portion of a retaining bar 90 of the type disclosed in U.S. patent application Ser. No. 09/487,820, as can be seen, for example, in FIGS. 6–7 and 10–11. The channel 24 also receives geosynthetic reinforcement material therein as best seen in FIGS. 10 and 11.

As disclosed in U.S. patent application Ser. No. 09/487,820, the reinforcement material is positively secured to the blocks by the retaining bar disposed within the channels of the blocks. However, for the corner blocks 10A, 10B, the channel 24 is designed differently from the channels in the blocks of U.S. patent application Ser. No. 09/487,820. The channel 24 simply receives the reinforcement material and the end portion of the retaining bar 90, without the securing or locking action between the retaining bar, the reinforcement material and the block channel found in U.S. patent application Ser. No. 09/487,820. Yet, because the end of the retaining bar extends into the channel 24, the corner blocks 10A, 10B benefit from the reinforcing action of the reinfocement material secured to the other blocks in the same course.

Figure 10:
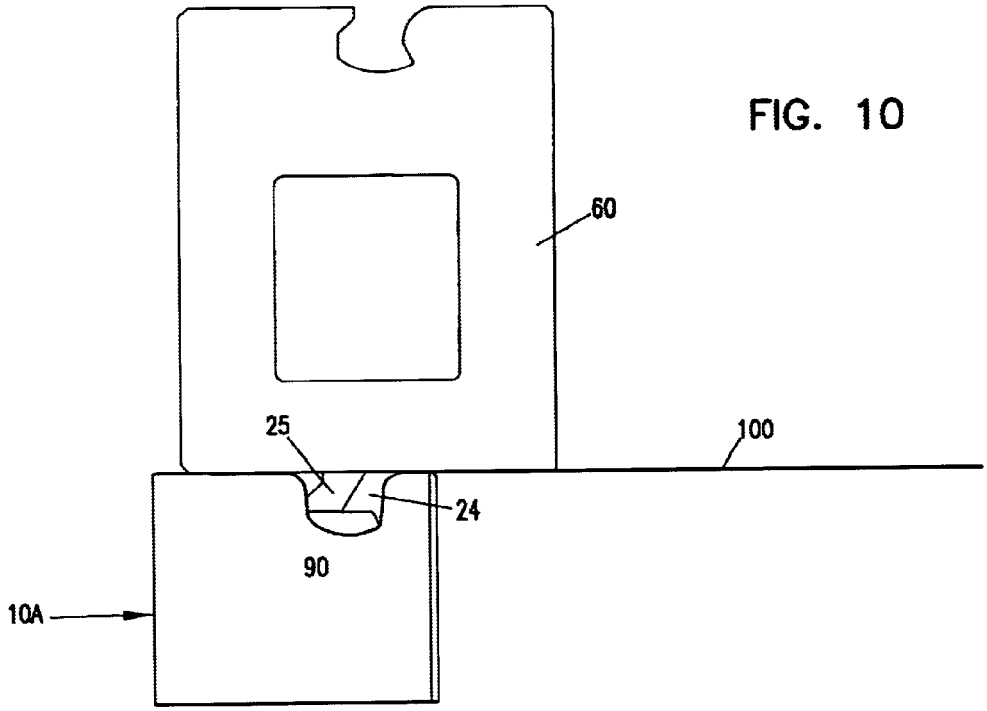
FIG. 10 is a side view of a corner block and a standard block showing the interaction of the channel, retaining bar and reinforcement material.
Figure 11:
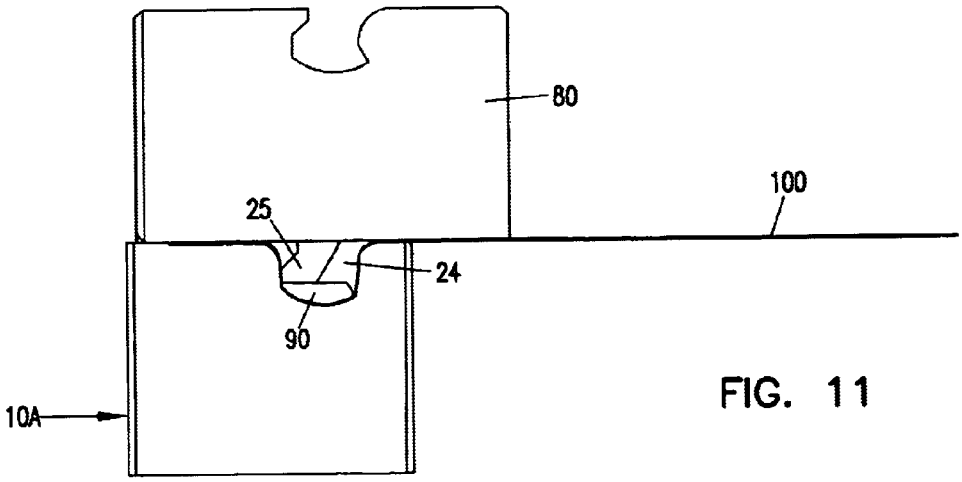
FIG. 11 is a side view of a corner block and a half high standard block showing the interaction of the channel, retaining bar and reinforcement material.

In addition to receiving the retaining bar 90 and reinforcement material 100, the channel 24 provides sufficient space to receive a lock flange 25 from a block in an upper course, as illustrated in FIGS. 10 and 11. The front of the lock flange 25 on the upper block is designed to abut the forward wall of the channel and provide a setback of the blocks in each course.

With reference to FIG. 2, the details of the channel 24 are shown. The channel 24 is defined by a front wall 26, a rear wall 28 spaced from the front wall 26, and a bottom wall 30. The front and rear walls 26, 28 diverge away from each other from the bottom of the channel 24 to the top of the channel 24, whereby the channel has an increasing width from bottom to top. The increasing width of the channel 24 permits a retaining bar to be received therein with slight play between the retaining bar and the walls 26, 28 of the channel. Further, the front and rear walls 26, 28 are connected to the top surface 20 via radiused edges 32, 34, and the bottom wall 30, which is preferably arcuate, connects to the front and rear walls 26, 28 via radiused sections 36, 38.

As evident from FIG. 2, the channel 24 is not symmetrical. This is achieved by making the rear wall 28 slightly longer than the front wall 26, so that the radiused section 38 is positioned lower than the radiused section 36. The bottom 30 of the channel 24 corresponds to the shape of the bottom of the retaining bar disclosed in U.S. patent application Ser. No. 09/487,820.

The size of the blocks 10A, 10B varies depending upon where the block is used, i.e. which course, in forming the corner. An example of the dimensions of a preferred block size are as follows: a length $d_1$ of about 17.5 inches; a width $d_2$ of about 9.0 inches; and a height $d_3$ of about 7.5 inches. In addition, an example of the dimensions for a preferred channel 24 shape and location are as follows: a length $d_4$ of about 14.5 inches; the closed end of the channel 24 being angled at an angle $\theta$ of about 5.0 degrees relative to vertical; a distance $d_5$ of about 1.580 inches; a distance $d_6$ of about 1.908 inches; a distance $d_7$ of about 0.745 inches; a distance $d_8$ of about 1.265 inches; a distance $d_9$ of about 0.096 inches; a distance $d_{10}$ of about 0.5 inches; a distance $d_{11}$ of about 1.728 inches; a distance $d_{12}$ of about 1.631 inches; a distance $d_{13}$ of about 2.810 inches; radii $r_1$ and $r_2$ of about 0.5 inches; a radius $r_3$ of about 2.115 inches; a radius $r_4$ of about 0.5 inches; and a radius $r_5$ of about 0.233 inches. These dimensions are exemplary only. Other dimensions for the blocks and channel are contemplated by and within the scope of the invention, depending upon the intended use of the blocks. The angle at the closed end of the channel 24 facilitates manufacturing by allowing the mold part that forms the channel 24 in the block to release easier.

Although capable of alternative construction, the blocks 10A, 10B are preferably formed of zero slump concrete. As is known in the art, the block material is commonly mixed in a batching plant in a high-speed process. Cement, aggregate, water, and possibly various admixtures are mixed in a hopper to form a concrete mixture which is placed into a mold box to form the blocks. To increase block output of this process and simplify the block forming process, typically a multiple block mold is used. In particular, the mold is configured to form a workpiece from which several blocks will be made. Once the workpiece is formed, the individual blocks are separated from the workpiece with a block splitter that splits through the workpiece. This splitting process also typically gives the exterior surfaces of the blocks a textured split-stone appearance.

FIG. 3 illustrates an exemplary workpiece 40 from which the blocks 10A, 10B are formed. The blocks 10A, 10B are formed side-by-side in the workpiece 40, and the workpiece is split along the axes x—x and y—y to produce the blocks 10A, 10B. The splitting process results in the surfaces 12, 16 of each block provided with a textured, split-stone appearance. The workpiece 40 can be split in a conventional splitting machine in a mechanical splitting process, which are known in the art.

Figure 4:
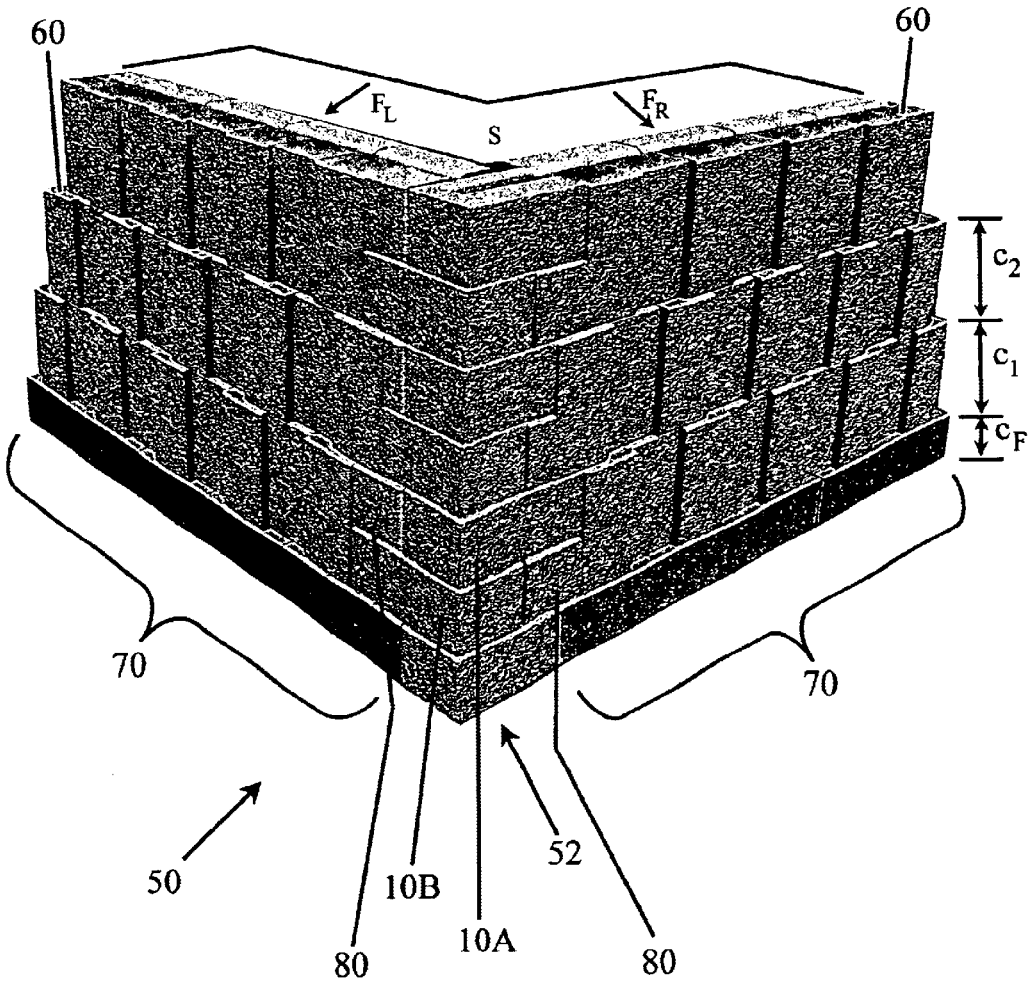
FIG. 4 is a perspective view of a portion of a wall structure with an exterior corner.

As discussed above, the blocks 10A, 10B are preferably used together with the blocks, as well as the retaining bar and geosynthetic reinforcement material, described in U.S. patent application Ser. No. 09/487,820, to form a wall structure that has an exterior corner. FIG. 4 illustrates a portion of a wall structure 50 having an exterior corner 52, with backfill soil S in place behind the wall structure. The forces $F_R$ and $F_L$ acting on the wall structure 50 and the corner 52 are illustrated. The force $F_R$ acts on the right-hand portion of the wall structure and corner in a direction tending to topple the right-hand portion of the wall structure. In contrast, the force $F_L$ acts on the left-hand portion of the wall structure and corner in a direction tending to topple the left-hand portion of the wall structure in a direction that is different from the direction of the right-hand portion.

In order to adequately reinforce the wall structure adjacent the exterior corner, geosynthetic reinforcement material is preferably secured to the right-hand portion of the wall structure adjacent to the blocks that form the corner 52, with the reinforcement material extending back into the soil S. Further, geosynthetic reinforcement material is also preferably secured to the left-hand portion of the wall structure adjacent to the blocks that form the corner 52, with the reinforcement material extending back into the soil.

Prior to describing the preferred formation of the wall structure and exterior corner, the terminology that will be used to describe the wall structure will be explained. The right and left-hand portions of the wall structure 50 are preferably constructed from a plurality of blocks of the type disclosed in U.S. patent application Ser. No. 09/487,820. These blocks will be referred to hereinafter for convenience as "standard blocks" and are designated by numeral 60. Standard blocks are also designated "STD" in FIGS. 8 and 9. For purposes of describing the inventive concept, the standard blocks 60 will be assumed to be about 15 inches in height (i.e. between the top and bottom surfaces), about 8 inches wide (i.e. the length between the side surfaces), and about 12 inches in depth (i.e. between the exterior and interior surfaces). Each standard block 60 includes a lock flange 25 on the bottom thereof that is designed to fit within channels in blocks of lower courses (see FIG. 10). The front of each lock flange 25 is designed to abut against the forward wall defining the channel to provide a setback of the blocks in an upper course from the blocks in the immediate lower course.

The wall structure 50 also preferably includes starter or foundation blocks as described in U.S. patent application Ser. No. 09/487,820, which will be hereinafter referred to for convenience as "foundation blocks" and are designated by numeral 70. Foundation blocks are also designated "FDN" in FIGS. 8 and 9. For purposes of describing the inventive concept, the foundation blocks 70, as is disclosed in U.S. patent application Ser. No. 09/487,820, will be assumed to have a locking channel, no lock flange, and a height about one-half the height of the standard blocks 60. Although foundation blocks are typically used, standard blocks could be used in place of foundation blocks.

Further included are blocks that are referred to herein for convenience as "half high standard blocks" and are designated by numeral 80. Half high standard blocks are also referred to as "HALF HIGH UNIT" or "HALF HIGH", and designated by "H", in FIGS. 8 and 9. The half high standard blocks 80 are similar in construction to the standard blocks 60, except they are about one-half the height of the standard blocks.

The remainder of the blocks are preferably the blocks 10A, 10B, which will be hereinafter referred to as "right corner block" 10A (or similar) and "left corner block" 10B (or similar), respectively. The right and left corner blocks are also referred to as "CORNER UNIT", and designated "CR" for a right corner block and "CL" for a left corner block, in FIGS. 8 and 9. In the preferred wall structure, the lengths of the half high standard blocks 80, the right corner blocks 10A, and the left corner blocks 10B vary in a manner to be described. The basic construction of the half high standard blocks 80, including the presence of the lock channel and the lock flange, will not vary by changing the length thereof. Of course, the specific dimensions of the lock channel and lock flange will vary based upon the length of the standard block that is used. In addition, the basic construction of the right and left corner blocks 10A, 10B, including the presence of a closed ended channel 24, will not vary by changing length thereof. As for the standard blocks, it is to be realized that the specific dimensions of the features of the right and left corner blocks would have to be modified to account for a change in block length.

The construction of a preferred wall structure will now be described with reference to FIGS. 5–9. Prior to laying blocks, a leveling pad is initially constructed to provide a base upon which to build the wall. Typically, this leveling pad comprises a layer of compacted, crushed stone. A leveling pad is described in U.S. patent application Ser. No. 09/487,820.

Figure 5:
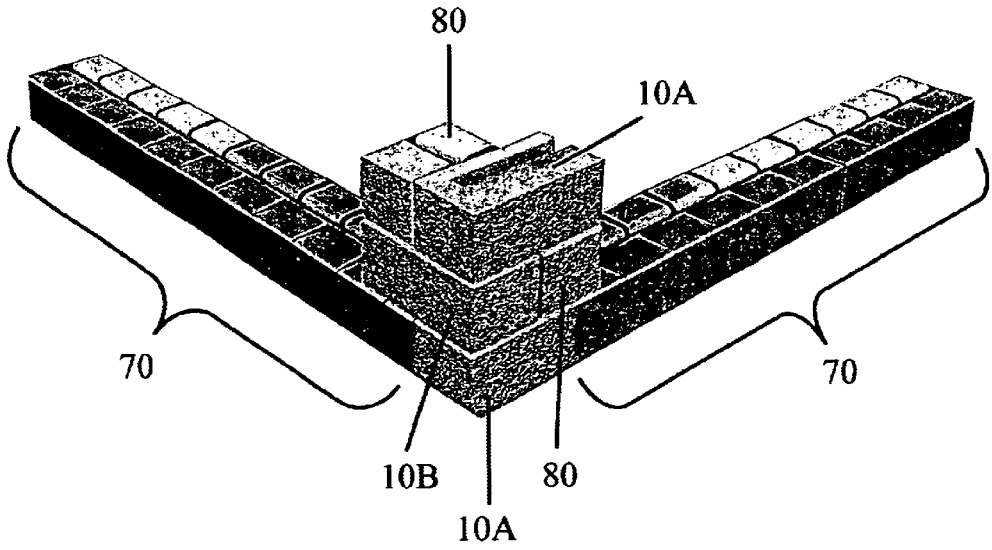
FIG. 5 is a perspective view of a partially constructed wall structure with an exterior corner according to the present invention.

Once the leveling pad is constructed, a plurality of the foundation blocks 70 are laid on the leveling pad to form the foundation of the right and left wall portions (see FIG. 5). In addition, a right corner block 10A having a length of, for example, about 14 inches and a foundation block 70 having a length of, for example, about 8 inches, are laid at the right corner. Further, a foundation block 70 having a length of, for example, about 5.0 inches is provided between the right corner block 10A and the remaining foundation blocks on the left-hand wall portion to complete what will be referred to as the foundation course $C_F$ (see FIGS. 5 and 9).

The wall structure 50 is formed from a plurality of courses $C_1$, $C_2$, . . . $C_n$. The construction of the standard blocks 60 is such that they occupy the entire height of each course. However, the blocks that form the exterior corner 52, i.e. the right and left corner blocks 10A and 10B and the half high standard blocks 80, are half the height of the standard blocks 60. Thus, for each course $C_1$, $C_2$, . . . $C_n$, the blocks at the exterior corner 52 are arranged into two subcourses $SC_{n1}$ and $SC_{n2}$ (see FIG. 9).

Figure 8:
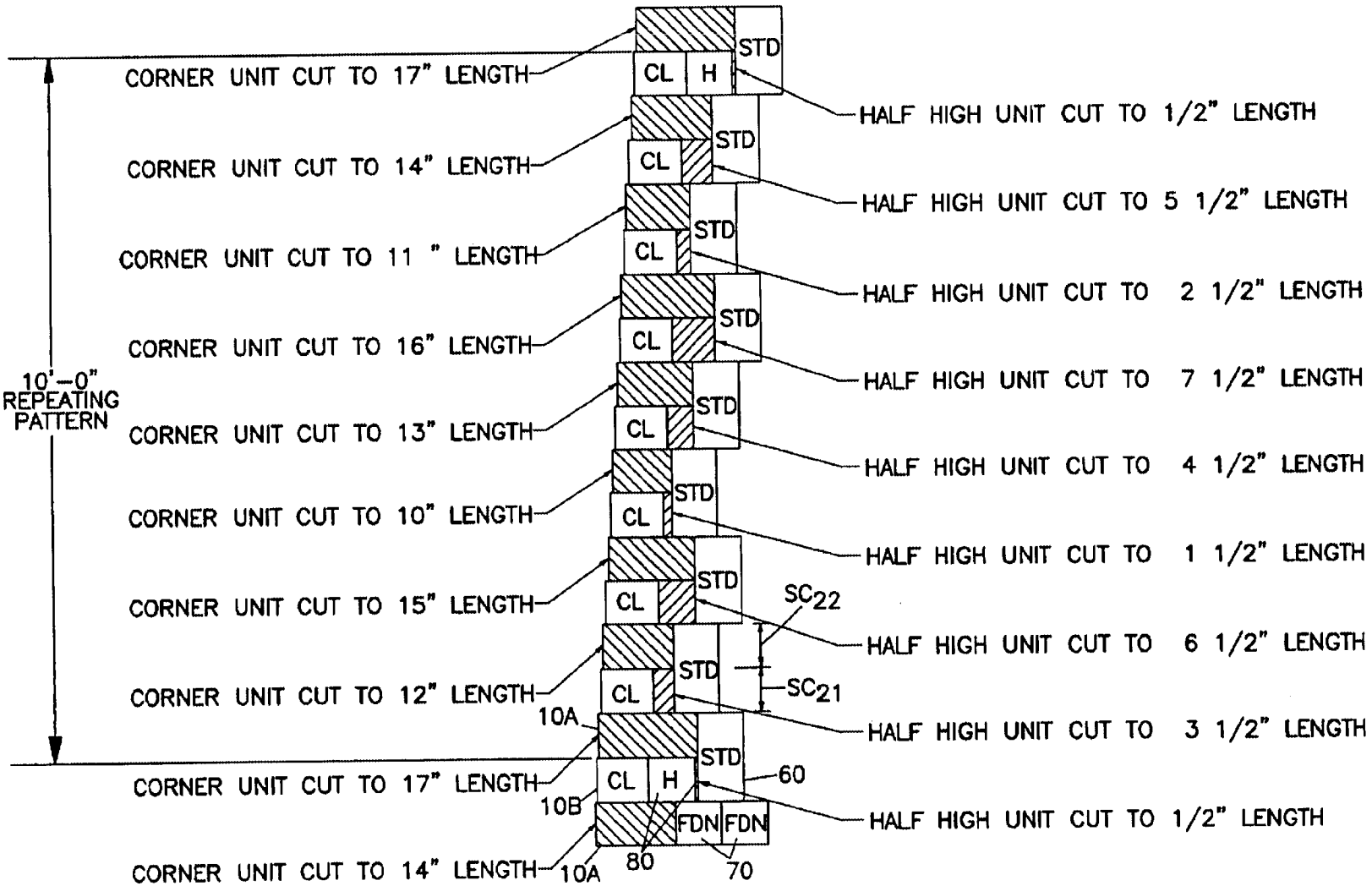
FIG. 8 illustrates the detailed block lay-up to form the right side of the exterior corner.
Figure 9:
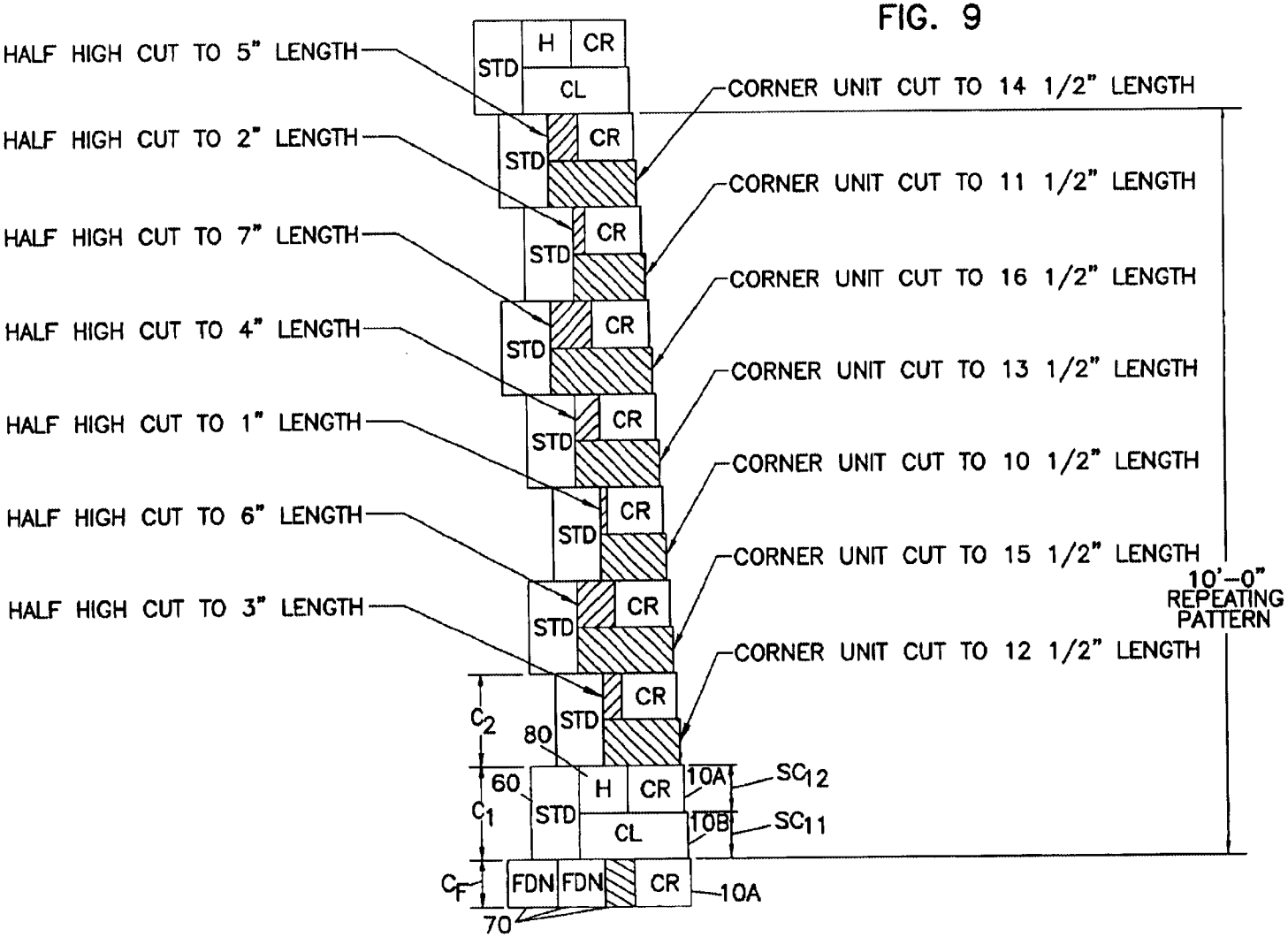
FIG. 9 illustrates the detailed block lay-up to form the left side of the exterior corner.

Referring to FIGS. 5, 6, 8 and 9, subcourse $SC_{11}$ of the first course $C_1$ is formed by a left corner block 10B, a half high standard block 80, and a partial, second half high standard block 80 (see particularly FIGS. 8 and 9). Subcourse $SC_{12}$ of course $C_1$ is formed by a right corner block 10A having a length of, for example, about 17.0 inches, and a half high standard block 80. The standard blocks 60 that are stacked onto the foundation blocks 70 abut against the subcourses $SC_{11}$ and $SC_{12}$, and complete the first course $C_1$.

Figure 6:
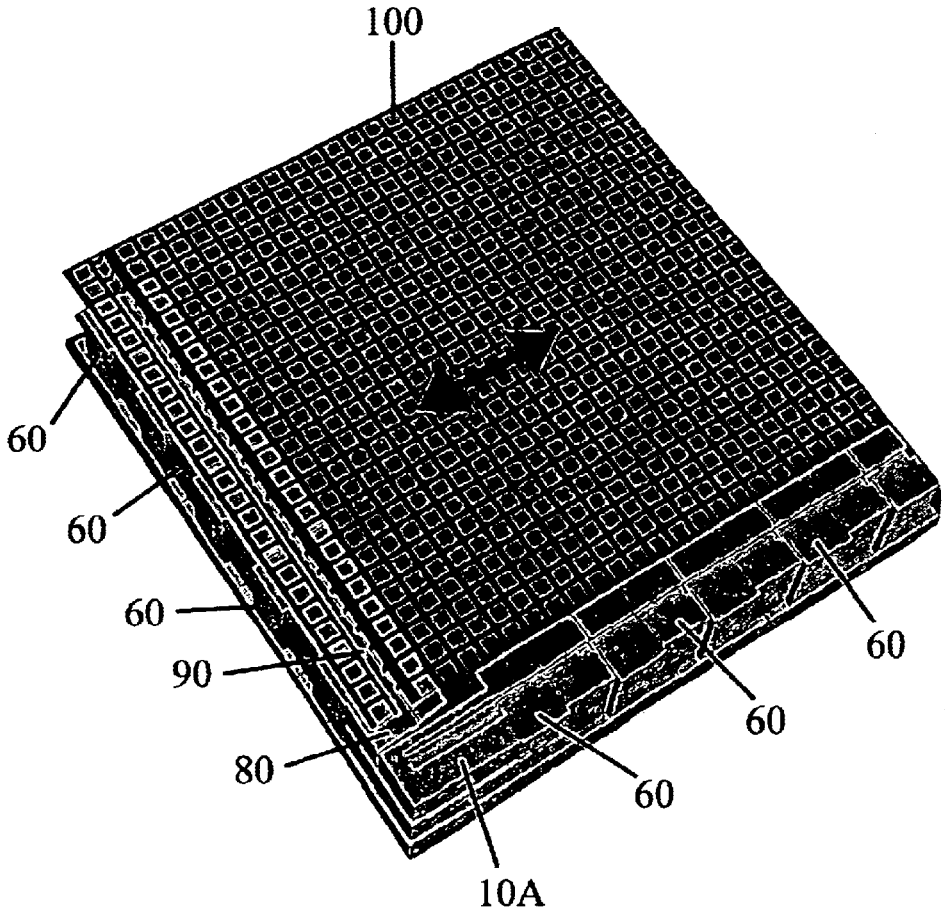
FIG. 6 is a perspective view of another stage of construction of the wall structure and exterior corner of FIG. 5.

As illustrated in FIG. 6, the channel of the half high standard block 80 in subcourse $SC_{12}$ is aligned with the channels of the standard blocks 60 that form the left-hand portion of the wall structure. A retaining bar 90 for geosynthetic reinforcing material 100, each of which is disclosed in U.S. patent application Ser. No. 09/487,820, is used to secure the reinforcing material 100 to the standard blocks 60 that form the left-hand portion of the wall. The end of the retaining bar 90 is also disposed within the channel of the half high standard block 80. Therefore, the edge of the reinforcing material is able to extend closely adjacent to the interior surfaces of the standard blocks 60 that form the right-hand side of the wall. Thus, the reinforcing material reinforces the left-hand portion of the wall against the forces $F_L$, with the direction of reinforcement being illustrated by a double-headed arrow in FIG. 6. Once the first course $C_1$ is completed, backfill soil S can be placed behind the blocks.

As FIG. 6 also illustrates, the channel in the right corner block 10A of subcourse $SC_{12}$ is aligned with the channels in the standard blocks 60 that form the right-hand portion of the wall. Another retaining bar can be used to secure geosynthetic reinforcing material to the standard blocks 60 forming the right-hand portion of the wall, with the end of the retaining bar also extending into the channel of the right corner block 10A. This construction would thereby reinforce the right-hand portion of the wall against the forces $F_R$. However, because reinforcing material is connected to the left-hand portion of the first course $C_1$, it is not preferred that reinforcing material be connected to the right-hand portion in the first course. Alternatively, the reinforcing material could be connected to the right-hand portion of the first course, rather than to the left hand portion, with reinforcing material connected to the left-hand portion of a later course.

In the second course $C_2$, the corner includes a subcourse $SC_{21}$ that is formed by a left corner block 10B having a length of, for example, about 12.5 inches, and a half high standard block 80 having a length of, for example, about 3.5 inches. The corner also includes a subcourse $SC_{22}$ that is formed by a right corner block 10A having a length of, for example, about 12.0 inches, and a half high standard block 80 having a length of, for example, about 3 inches (see FIGS. 4, 7, 8 and 9). The remainder of the second course $C_2$ is completed by the standard blocks 60 which abut against the subcourses $SC_{21}$ and $SC_{22}$.

Figure 7:
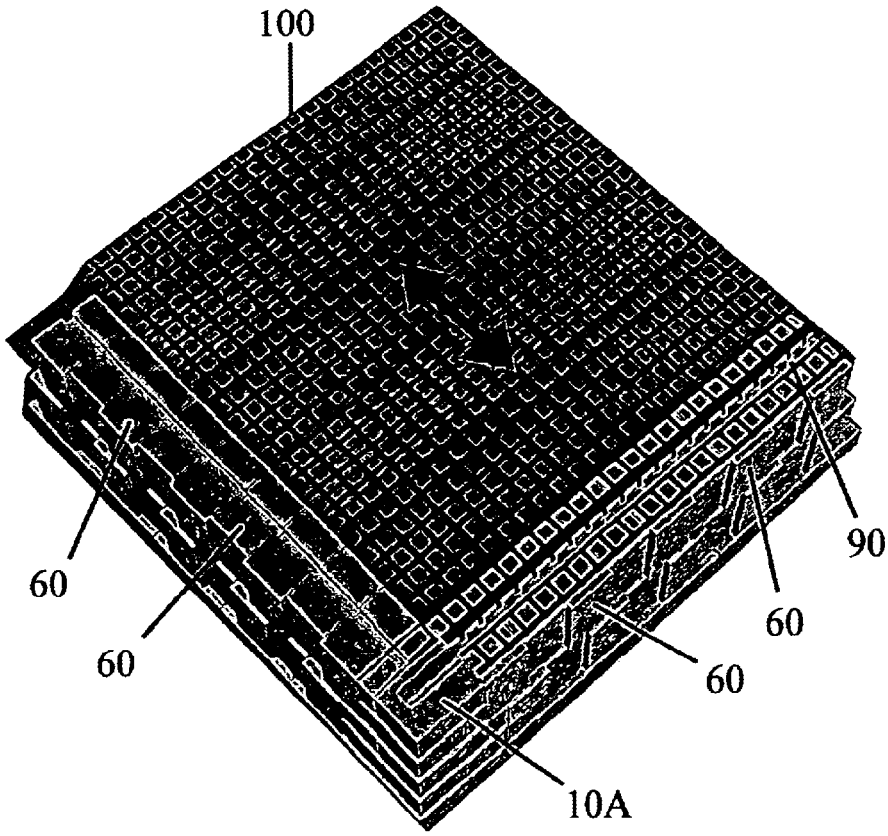
FIG. 7 is a perspective view of another stage of construction of the wall structure and exterior corner.

When the second course $C_2$ is complete, the channel in the right corner block 10A of subcourse $SC_{22}$ is aligned with the channels in the standard blocks 60 as illustrated in FIG. 7. A retaining bar 90 is then used to secure reinforcing material 100 to the blocks forming the right-hand portion of the wall, with the end of the retaining bar also extending into the channel of the right corner block 10A. This reinforces the right-hand portion of the wall against the forces $F_R$. The direction of reinforcement is illustrated by a double-headed arrow in FIG. 7.

The remaining courses of the wall are constructed in similar fashion to the first two courses $C_1$ and $C_2$, with first and second subcourses $SC_{n1}$ and $SC_{n2}$ forming the exterior corner and standard blocks completing each course. The blocks and exemplary block sizes that are used to form the corners of seven additional courses is schematically set forth in FIGS. 8 and 9.

For each course, the lock flange(s) 25 of a standard block or half high standard block of an upper course will extend into the channel 24 of the corner blocks 10A, 10B above the retaining bar 90 that is disposed in the channel to help retain the retaining bar and reinforcing material 100 within the channel 24 (see FIGS. 10 and 11). As shown in FIGS. 10 and 11, the reinforcing material 100 extends from between the top surface of the lower block and the bottom surface of the upper block and into the channel 24. The bar 90 is on top of the material 100 and presses the material 100 toward the bottom of the channel 24. The lock flange 25 from the upper block 60, 80 extends close to, or into engagement with, the top of the bar 90 to prevent the bar and, thus the material 100, from being pulled from the channel 24 as long as the blocks 60, 80 are in place.

When the blocks and exemplary block sizes set forth in FIGS. 8 and 9 are used, a repeating pattern of blocks at the corner 52 is formed every 10.0 feet. It is to be realized that the actual height of the wall will be dictated by the surrounding landscape. A smaller or larger number of courses than is shown in FIGS. 8 and 9 could be used, depending upon the required wall height. Moreover, for each course that is laid, reinforcing material can be secured to either the right-hand portion or left-hand portion of the wall, as the builder sees fit to provide adequate wall reinforcement. When the desired wall height is reached, cap blocks, such as those described in U.S. patent application Ser. No. 09/487,820 can be used to complete the wall.

As seen in FIGS. 4, 8 and 9, the different lengths of the right and left corner blocks, and of the half high standard blocks, eliminates alignment or patterning of the joints formed by the blocks in the plurality of courses. The random location of the various joints is generally thought to provide a more pleasing and attractive appearance to the wall.

The right-side and left-side wall portions have been illustrated as being generally linear. However, the standard blocks 60 can be constructed to permit the construction of curved wall portions that are provided with an exterior corner as described herein. As will be appreciated by those having skill in the art, when a curved wall portion is constructed, the retaining bar will likewise need to be curved if reinforcing material is to be extended from the blocks of the curved wall portions.

While preferred embodiments of the invention have been disclosed in detail in the foregoing description and drawings, it will be understood by those skilled in the art that variations and modifications thereof can be made without departing from the spirit and scope of the invention which resides in the claims hereinafter appended.

We claim:

1. A corner block for use in a retaining wall, the corner block comprising:

a block body having, when the block body is laid up in a retaining wall in its intended orientation, opposed side surfaces, opposed end surfaces, a top surface having a texture, and a bottom surface, at least one of said surfaces and one of said end surfaces being textured, the degree of texturing of the side surface and the end surface being greater than the degree of texturing of the top surface; and a channel formed in said top surface for receiving a portion of an elongated retaining member, said channel having a longitudinal axis extending parallel to said side surfaces, said channel further including an open end that extends through one of said end surfaces and a closed end that terminates short of the opposite said end surface, and said channel being defined by at least a front wall, a rear wall opposite the front wall, and a bottom wall, said channel has a depth adjacent said rear wall that is greater than a depth of said channel adjacent said front wall, wherein said rear wall is greater in height than the front wall, and wherein said front and rear walls of said channel diverge from the bottom of said channel to the top of said channel, whereby said channel has an increasing width from bottom to top, and wherein said channel is sized to receive therein the portion of the elongated retaining member extending parallel to the longitudinal axis of said channel with no portion of the elongated retaining member projecting above said top surface.

2. A wall structure having an exterior corner constructed from a plurality of corner blocks of claim 1.

3. A corner block according to claim 1, wherein the channel is position closer to one of the side surfaces than it is to the other side surface.

4. A corner block according to claim 1, wherein the side surfaces are generally parallel to each other.

5. A corner block according to claim 4, wherein the end surfaces are generally parallel to each other.

6. A corner block according claim 5, wherein the top and bottom surfaces are generally parallel to each other.

7. A retaining wall, comprising:

a first plurality of concrete blocks and a second plurality of concrete blocks arranged into courses, the first plurality of blocks defining an exterior corner of the wall and the second plurality of blocks being arranged side-by-side and atop one another to define a wall portion adjacent the exterior corner, wherein each block of the second plurality of blocks has a first height that defines the height of each course, and the blocks of the first plurality of blocks each have a second height that is less than the first height, wherein the exterior corner of each course is formed by a plurality of subcourse blocks of the first plurality of blocks, and for each course the subcourse blocks are arranged into first and second subcourses that have a combined height that is substantially equal to the first height.

8. A retaining wall, comprising:

a plurality of courses, each course comprises a first plurality of blocks forming an exterior corner portion and a second plurality of blocks forming a wall portion adjacent the exterior corner portion, each block of said first plurality of blocks and said second plurality of blocks including a channel formed in a top surface thereof;

wherein, for each course, each block of said second plurality of blocks has a first height that defines the height of the course and each block of said first plurality of blocks has a second height that is less than the first height; and a reinforcement member retaining bar disposed within the channels in said second plurality of blocks, and at least a portion of said retaining bar being disposed within the channel of at least one block of the first plurality of blocks.

9. A retaining wall according to claim 8, further including a reinforcement member secured to said second plurality of blocks by said retaining bar, said reinforcement member extending into said channels of said second plurality of blocks.

10. A retaining wall according to claim 8, wherein the channels of said second plurality of blocks are aligned with the channel of the one block of said first plurality of blocks.

11. A retaining wall according to claim 8, wherein, for each course, the blocks of said first plurality of blocks are arrange into first and second subcourses, and the combined height of said first and second subcourses substantially equals the first height.

12. A retaining wall, comprising:

a first plurality of blocks and a second plurality of blocks arranged into courses, the first plurality of blocks defining an exterior corner of the wall and the second plurality of blocks defining a wall portion adjacent the exterior corner, wherein each block of the second plurality of blocks has a first height that defines the height of each course, and the blocks of the first plurality of blocks each have a second height that is less than the first height, wherein the exterior corner of each course is formed by a plurality of subcourse blocks of the first plurality of blocks, and for each course, the subcourse blocks are arranged into first and second subcourses and the first and second subcourses have a combined height that is substantially equal to the first height.

* * * * *